United States Patent [19]

Quam

[11] Patent Number: 4,976,375

[45] Date of Patent: Dec. 11, 1990

[54] WASTEBASKET DIVIDER

[75] Inventor: Roger C. Quam, Gem Lake, Minn.

[73] Assignee: Waste-Not, Inc., Willernie, Minn.

[21] Appl. No.: 325,681

[22] Filed: Mar. 20, 1989

[51] Int. Cl.[5] ..... B65D 25/06

[52] U.S. Cl. ..... 220/534; 220/530; 220/531; 220/549; 220/908

[58] Field of Search ..... 220/1 T, 22, 22.1, 22.2, 220/22.3, 22.5

[56] References Cited

U.S. PATENT DOCUMENTS

| | | | |
|---|---|---|---|
| 52,905 | 1/1819 | Young . | |
| 179,645 | 2/1857 | Hungerford . | |
| 187,796 | 5/1860 | Vuici . | |
| 241,295 | 9/1876 | Entin . | |
| 617,445 | 1/1899 | Nathan . | |
| 1,598,467 | 9/1925 | Weeks . | |
| 2,415,054 | 1/1947 | Weil | 220/22.5 |
| 3,381,875 | 5/1968 | Tunick | 220/22 |
| 3,720,346 | 3/1973 | Cypher . | |
| 4,130,153 | 12/1978 | Zopf . | |
| 4,420,083 | 12/1983 | Baustin | 220/22.1 |
| 4,739,894 | 4/1988 | Pender . | |
| 4,750,639 | 6/1988 | Schaerer . | |

FOREIGN PATENT DOCUMENTS

| | | | |
|---|---|---|---|
| 3636019 | 4/1988 | Fed. Rep. of Germany . | |
| 43918 | 10/1969 | Finland | 220/22.5 |
| 8300820 | 10/1964 | Netherlands | 220/1 T |

*Primary Examiner*—George E. Lowrance

*Attorney, Agent, or Firm*—Merchant, Gould, Smith, Edell, Welter & Schmidt

[57] ABSTRACT

An apparatus (10) for dividing a wastebasket (13) into multiple compartments (16, 17) is disclosed. The wastebasket divider apparatus (10) includes a base member (12) interconnected to a vertical divider wall (11). The position of the divider wall (11) is adjustable by means of a slot (18) formed by flanges (19). Also disclosed are alternative embodiments of the wastebasket apparatus (22, 33) in which the divider wall (28, 38) is provided with pins (29, 39) which correspond with either a pair of grooves (27) or a plurality of indentations (40) formed with the side walls (25, 35) so as to allow for adjustment of the divider wall (28) (38) within the wastebasket framework (23, 24).

10 Claims, 2 Drawing Sheets

FIG. 1
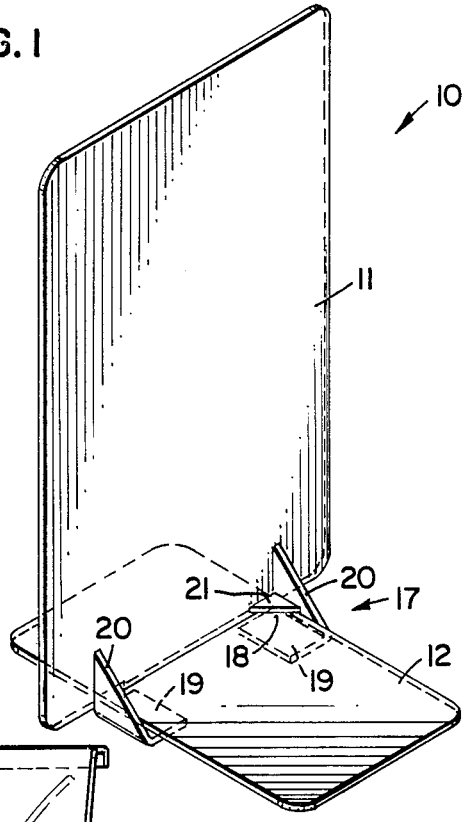
FIG. 2
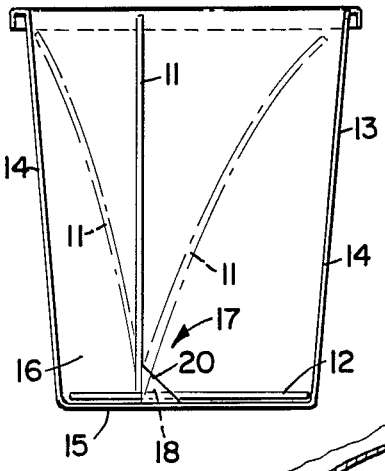
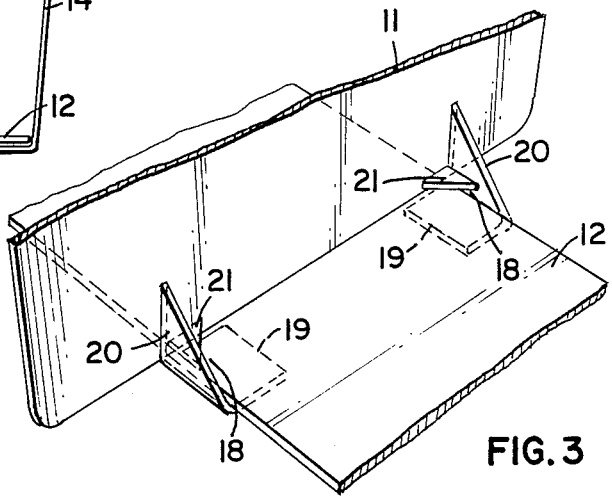
FIG. 3

WASTEBASKET DIVIDER

FIELD OF THE INVENTION

The present invention relates generally to trash receptacles and more particularly to an apparatus for dividing a trash receptacle into separate compartments of adjustable size for receipt of different types of trash materials in order to facilitate recycling.

BACKGROUND OF THE INVENTION

Trash disposal has become a troublesome aspect of the pollution control problem, and solutions incorporating source separation of the trash have been largely unsuccessful. At the present time, various types of trash, such as cans, paper, bottles and the like, are collected periodically and deposited in garbage dumps, land areas to be filled, incineration plants, and so on. The available trash depositories, however, are rapidly being filled by the ever-increasing quantities of trash. Accordingly, it has become necessary to develop other methods of trash disposal.

One of the trash disposal methods which is gaining increased attention involves reuse of the trash materials. This is commonly referred to as recycling the trash materials. Recycling involves the processing of certain types of trash material to a reusable form. For example, it has been estimated that approximately 85% of the wastepaper thrown out today could be recycled. Recycling necessitates segregation of the various kinds of trash materials such that they can be processed or recycled. However, segregation at the recycling facility presents such a monumental task as to render this approach impractical. Segregation at the source is the ideal solution. Accordingly, some municipal regulations require a home owner or business establishment to separate garbage into different types, for example, to separate bottles, aluminum cans, paper, plastic containers, newspapers and the like from each other not only for recycling purposes but also to reduce the amount of residual garbage which requires removal to a garbage dump, land fill or incineration plant.

Conventional garbage containers have generally been of a single chamber type so that different types of garbage can be deposited therein for subsequent removal. When required to separate garbage into different types, home owners and business establishments have usually resorted to setting aside separate containers for each type of garbage. For example, one container may be set aside for aluminum cans, a second container for plastic materials, a third container for newspapers and paper, and a fourth container for any remaining garbage. However, this requires a rather large amount of space and is not generally convenient to home owners and businesses.

In other cases, compartmented trash receptacles have been developed. Generally, these receptacles have a plurality of containers which are disposed in side-by-side relation within a common housing or which are held together by a common cover. However, there are several drawbacks associated with such receptacles. For example, the garbage-receiving compartments are often of insufficient size, making the trash receptacle ineffective and inconvenient for the user. In addition, these types of multiple-compartment trash receptacles often require cumbersome support structures, resulting in substantial manufacturing and replacement costs. Further, the individual compartments are typically difficult and time-consuming to empty. Besides these operational disadvantages, these types of receptacles are also typically not aesthetically pleasing.

In office situations, some recycling programs have required the janitorial crew to hand-sort the contents of wastebaskets to remove recyclable materials. This task is not only unpleasant, but it is also very time-consuming and labor-intensive. In addition, manual sorting can be dangerous to the worker, who puts himself at risk for cuts and other injuries.

Other office recycling programs have required office employees to use a secondary container such as a cardboard tray or additional wastebasket for placement of recyclable paper. However, these trays have met with little success, because these containers take up valuable work space, there being insufficient space on the employee's desk or elsewhere for placement of the tray. In addition, the trays are normally aesthetically displeasing.

Another complication relates to the way in which the trash is collected and handled by the housekeeping staff before it is ultimately picked up for disposal. When the above recycling programs are utilized, the housekeeping staff must empty the separate trays, wastebaskets and/or barrels, often necessitating an additional pass through the area to be cleaned. The custodian's cleaning flow pattern is broken up by the additional steps required to pick up desk trays and empty them into separate containers. In some cases, the custodian must pull an additional waste cart with him, resulting in possible damage to the furniture and additional inconvenience. This disrupts the cleaning schedule and leads to cost increases, inconvenience, and decline in morale for the housekeeping personnel.

The present invention addresses these and many other problems associated with currently available trash recycling solutions.

SUMMARY OF THE INVENTION

The present invention comprises an apparatus for dividing the wastebasket into multiple compartments for the deposit of different types of trash materials to facilitate recycling. The wastebasket divider apparatus includes a base member and a divider wall interconnected to the base member so as to define multiple compartments within the wastebasket. Adjustment means are provided for moving the position of the divider wall so as to adjust the size of the trash compartments. According to one aspect of the invention, the adjustment means is a slot formed within the bottom end of the divider wall which accommodates the base member, thereby allowing movement of the divider wall with respect to the base member.

According to another aspect of the invention, a wastebasket apparatus is disclosed in which the divider wall, positioned within the wastebasket framework, has a pair of pins at its bottom end. The pins are accommodated by a plurality of corresponding indentations formed within an opposite pair of the wastebasket framework side walls, so as to allow for adjustment of the divider wall position and adjustment of the compartment sizes. Another aspect of the wastebasket apparatus provides for a pair of grooves in the side walls which accommodate pins in the divider wall, there also being suitable support means such as brackets or clips members to maintain the divider wall in a substantially upright position.

The wastebasket divider device of the present invention is useful in a wide variety of situations, including offices, households, and any other source which generates trash materials which may at least in part be recyclable. The present invention is particularly advantageous in that it can be installed in an existing trash receptacle or wastebasket without any retrofitting or replacement of the wastebasket itself. The wastebasket divider device is completely supported within the wastebasket and remains therein at all times, including when the trash receptacle is being emptied. The wastebasket divider can easily be constructed in a variety of sizes to conform with different sizes and shapes of trash receptacles. Because an existing, conventional wastebasket is utilized, there is no change in the aesthetics of the home or office environment due to the wastebasket divider device of the present invention. In addition, the user need not expend significant amounts of money to provide completely new wastebaskets in order to achieve the benefits of a recycling program.

Another feature of the present invention is that it is simple in construction and inexpensive to manufacture. The wastebasket divider apparatus has relatively few parts, and it can be cheaply manufactured and assembled, resulting in a wastebasket divider which is rugged and durable.

Another advantage of the present invention is that additional containers for different categories of trash are not necessary, thereby saving space and improving the appearance over multiple containers. Because of the pleasing appearance and operational simplicity of the present invention, users are more likely to comply with the recycling program.

The apparatus of the present invention also reduces the time and effort required to empty multiple trash containers. With the present invention, the non-recyclable compartment and the recyclable compartment can both be emptied by the housekeeping personnel during the same stop by merely shifting the position of the divider wall during the trash emptying procedure. This allows one compartment to be closed off while another compartment is being emptied into the appropriate trash receiving receptacle.

Another advantage of the wastebasket divider of the present invention is that the size of the compartments formed by the divider are adjustable according to the different amounts of each type of trash or recyclable material generated. The divider wall can be easily adjusted by the user at any time to change the compartment sizes to compensate for different amounts of trash materials, thus allowing the device to be used by many different types of users and to meet a variety of demands.

For a better understanding of the invention, and of the advantages obtained by its use, reference should be made to the Drawing and accompanying descriptive matter, in which there are illustrated and described preferred embodiments of the invention.

BRIEF DESCRIPTION OF THE DRAWING

Referring particularly to the Drawing, wherein like reference numerals indicate like parts throughout the several views:

FIG. 1 is a perspective view of the first embodiment of the wastebasket divider device of the present invention;

FIG. 2 is a side elevational view of the wastebasket divider device illustrated in FIG. 1, positioned within a conventional wastebasket;

FIG. 3 is an enlarged perspective view of the bottom portion of the wastebasket divider device illustrated in FIGS. 1–2;

DETAILED DESCRIPTION OF THE PREFERRED EMBODIMENTS

Figure 4:
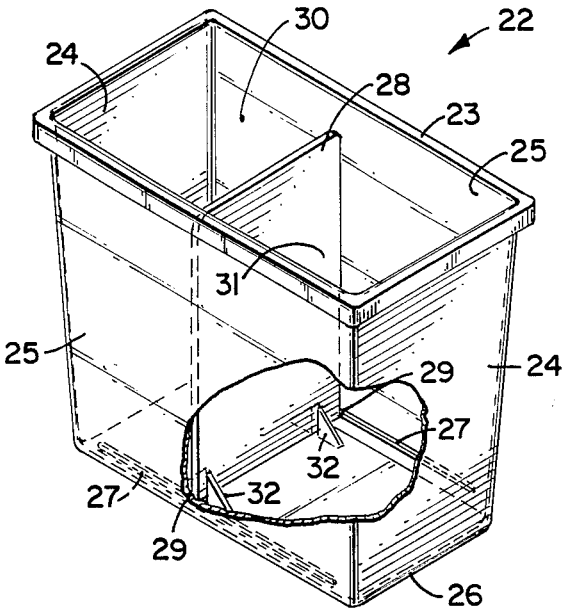
FIG. 4 is a perspective view of a second embodiment of the wastebasket apparatus of the present invention.

Referring to the drawings, the preferred embodiment of the wastebasket divider device of the present invention is illustrated generally at 10. The wastebasket divider 10 consists of a divider wall 11 and base member 12. The divider wall 11 is a flat, planar member of rectangular shape in the preferred embodiment which is positioned vertically within a wastebasket during normal use. Alternatively, the divider wall 11 could be tapered so as to be smaller in width at its bottom end and able to fit within similarly-shaped tapered wastebaskets. The base member 12 is a flat, planar member which is positioned horizontally against the bottom of the wastebasket 13.

FIG. 2 illustrates the wastebasket divider device 10 in its operative position within a conventional wastebasket or trash receptacle 13. The wastebasket 13 may be of a variety of shapes and sizes, but is rectangular in shape in the preferred embodiment. The wastebasket 13 has four side walls 14 and a bottom wall 15. In the preferred embodiment, the wastebasket 13 is open at its upper end, so as to allow for quick deposit of the trash materials therein. It is to be understood, however, that the wastebasket 13 could also be provided with a suitable, removable cover (not shown). As illustrated in FIG. 2, the base member 12 is positioned against the bottom wall 15 of the wastebasket. The base member 12 is preferably sized and configured to correspond to but be slightly smaller than the dimensions of the wastebasket's bottom wall 15. The wastebasket apparatus 10 is retained within the wastebasket 13 at all times, including when the wastebasket 13 is being emptied of its contents. However, if it is desired to remove the wastebasket divider apparatus 10 from the wastebasket 13 for purposes such as cleaning, such removal is possible by grasping the divider wall 11 and lifting upwardly so as to withdraw the wastebasket divider apparatus 10.

In its normal, operative position within the wastebasket 13, the divider wall 11 is in an upright position which is perpendicular to the base member 12. This position is illustrated by the solid lines in FIG. 2. The divider wall 11 is sized and configured to be slightly smaller than the cross-sectional dimension of the wastebasket 13. In the preferred embodiment, the divider wall 11 is parallel to the narrow side walls 14 of the wastebasket 13. The divider wall 11 thus forms two, completely separate compartments 16 and 17. The compartments 16, 17 are defined by the divider wall 11 and the wastebasket side walls 14.

The compartment 16 is designated for the receipt of a certain type of trash materials, e.g., recyclable paper. The compartment 17 is designated for another type of trash materials, e.g., non-reusable trash materials. It is to be understood that the compartments 16, 17 could be designated for a wide variety of different materials. In the preferred embodiment, the two sides of the divider wall 11 have appropriate labels to remind the user of the type of trash materials to be deposited in the compartment 16. An example of such labels would be a "Recyclable" label on the left side of the divider wall 11 and "Non-recyclable" label on the right side of the divider wall 11, as viewed in FIG. 2.

It is to be understood that the divider wall 11 could be of other configurations in order to divide the wastebasket 13 into more than two compartments. For example, it is within the scope of the invention for the divider wall 11 to consist of two perpendicular wall members (not shown) in a cross configuration, with one wall member being parallel to the length of the wastebasket and another, perpendicular wall member being transverse to the longitudinal access of the wastebasket. This design would allow for separation of the wastebasket 13 into four compartments.

The divider wall 11 and base member 12 are separate pieces which are attached to each other by suitable interconnection means 17. Proximate the bottom end of the divider wall 11 are a pair of bracket members 20. The bracket members 20 are L-shaped, each having a pair of perpendicular legs, an upright leg and a horizontal leg. The horizontal leg or flange 19 extends slightly below the bottom edge of the divider wall 11 so as to define a slot 18. The base member 12 is inserted through the slot 18, with the width of the slot 18 being slightly larger than the thickness of the base member 12 to allow for a slidable interconnection. In the preferred embodiment, the brackets are provided with reinforcement members 21. As shown in the drawings, the brackets 20 maintain the divider wall 11 in its upright position during normal use.

In the preferred embodiment, the divider wall 11 and bracket 20 are made of a suitable molded plastic material. The brackets 20 are of unitary construction with the divider wall 11. The base member 12 is also of a suitable molded plastic material in the preferred embodiment.

A novel feature of the present invention is the ease with which the size of the compartments 16, 17 can be adjusted. This is accomplished by simply moving the divider wall 11 with respect to the stationary base member 12. If, for example, the user needs to deposit a substantial amount of trash materials within the recyclable compartment 16, the divider wall 11 can be moved to the right as viewed in FIG. 2 so as to provide sufficient space for the recyclable materials.

The dashed lines in FIG. 2 illustrate the positions in which the divider wall 11 is placed when the wastebasket 13 is being emptied into a suitable trash receiver receptacle (not shown). If, for example, the recyclable compartment 16 is being emptied, the housekeeping personnel moves the divider wall 11 to the right as viewed in FIG. 2 so that the upper end of the divider wall 11 is proximate or touching the upper end of the side wall 14. This allows the compartment 16 to be emptied without interference from trash materials in the other compartment 17, because the compartment 17 is closed off by the divider wall 11. When the compartment 17 is being emptied, the upper end of the divider wall 11 is moved to the left and a similar process is employed. In the preferred embodiment, the divider wall 28 is made of a suitable material such as plastic which allows for sufficient flexing of the divider wall 28 to accommodate this emptying procedure. This allows the housekeeping personnel to quickly empty the various compartments 16, 17 of the wastebasket 13, without the necessity of having to sort through the trash materials and without the various types of trash materials becoming intermingled.

In operation of the first embodiment of the invention, the wastebasket divider apparatus 10 is positioned within the wastebasket 13 so as to form two compartments 16, 17. The user deposits the appropriate types of waste materials in the designated compartments 16, 17. When adjustment of the compartment sizes is desired, the divider wall 11 is slid relative to the stationary base member 12 by means of the slot 18. When the compartments 16, 17 are emptied, the divider wall 11 is moved so as to close off the compartment 16, 17 which is not being emptied.

A second embodiment of the present invention is illustrated generally at 22 in FIG. 4. The wastebasket apparatus 22 includes a trash receptacle framework 23, the framework 23 having a pair of transverse side walls 24, a pair of longitudinal side walls 25, and a bottom wall 26, thereby forming an enclosure. Proximate the bottom end of the longitudinal side walls 25 are a pair of longitudinal slots or grooves 27 which are formed within the side walls 25. Positioned within the wastebasket framework 23 is a divider wall 28. In the preferred embodiment, the divider wall 28 is planar and extends across the narrower dimension of the wastebasket framework 23, i.e., parallel to the transverse side walls 24.

Proximate the bottom end of the divider wall 28 are a pair of opposite pins 29 which extend outwardly from the side edges of the divider wall 28. The grooves 27 accommodate the pins 29, thereby providing adjustment means for moving the divider wall 28 so as to adjust the size of the compartments 30, 31 formed by the divider wall.

Another feature of the second embodiment 22 is a suitable support means which serves to maintain the divider wall 28 in an upright position during normal use. In the preferred embodiment, the support means comprises bracket members 32 proximate the bottom end of the divider wall 28.

In operation of the second embodiment illustrated in FIG. 4, the wastebasket framework 23 and divider wall 28 form two compartments 30, 31 for the deposit of different types of trash materials. When the size of the compartments 30, 31 is to be adjusted, the divider wall 28 is moved by the user by means of the pins 29 within the grooves 27. Movement of the divider wall 28 to close off one compartment facilitates emptying of the compartments 30, 31 as described above with the first embodiment.

Figure 5:
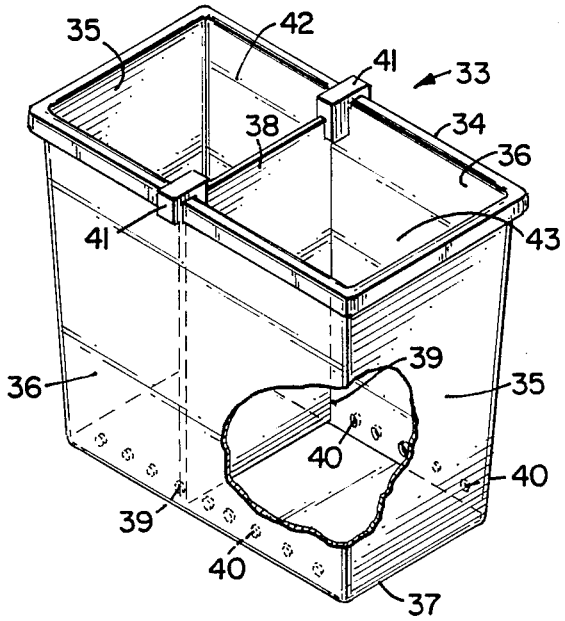
FIG. 5 is a perspective view of a third embodiment of the wastebasket apparatus of the present invention.

A third embodiment of the present invention is illustrated generally at 33 in FIG. 5. The wastebasket apparatus 33 includes a framework 34 which forms an enclosure defined by transverse side walls 35, longitudinal side walls 36, and a bottom wall 37. Positioned within the framework 34 is a divider wall 38 similar to the divider wall 28 described in conjunction with FIG. 4. Proximate the bottom end of the divider wall 38 are a pair of pins 39 which extend outwardly from the side edges of the divider wall 38.

Proximate the bottom end of each longitudinal side wall 36 are a plurality of holes or indentations 40 formed therein. The holes 40 are sized and configured to accommodate the pins 39. The pins 39 can be withdrawn and snapped into place from the indentations 40 so as to allow adjustment and movement of the divider wall 38 as desired. This embodiment of the invention also includes suitable support means to maintain the divider wall 38 in an upright position during normal use. In the preferred embodiment, the support means comprises a pair of clips 41. The clips 41 serve to interconnect the upper end of the wastebasket side walls 36 to the upper end of the divider wall 38.

In operation of the third embodiment illustrated in FIG. 5, adjustment of the sizes of the compartments 42, 43 is accomplished by removing the clips 41 and moving the pins 39 into a different pair of oppositely disposed holes 40. When emptying is desired, the clips 41 are removed so as to enable movement of the divider wall 38 to close off one compartment while the other compartment is being emptied. After emptying, the clips 41 are replaced so as to maintain the divider wall in its normal, upright position.

Although the present invention has been described with reference to three particular embodiments, it should be understood that those skilled in the art may make many other modifications without departing from the spirit and scope of the invention as described by the appended claims. For example, it is to be understood that the present invention could be redesigned so as to fit within odd-shaped or round wastebaskets by varying the size of the various components.

What is claimed is:

1. An apparatus for dividing a wastebasket having side walls and a bottom wall into multiple compartments, comprising:

(a) a base member;

(b) a divider wall having an upper end and an opposite bottom end interconnected to said base member, first and second compartments being defined by said divider wall and the wastebasket side walls, wherein movement of said upper end of said divider wall in a first direction allows an upper end of said first compartment to be closed off, and movement of said upper end of said divider wall in a second direction allows an upper end of said second compartment to be closed off; and (c) means for adjusting the position of said divider wall relative to said base member, wherein said adjustment means allows for changing the size of said compartments.

2. The apparatus of claim 1, wherein said adjustment means comprises a slot proximate the bottom end of said divider wall, said base member being inserted through said slot so that said divider wall is movable along said base member.

3. The apparatus of claim 2, wherein said apparatus is made of a plastic material.

4. The apparatus of claim 2, wherein said slot is formed by a pair of L-shaped bracket members, each having two legs, one leg of said bracket member being of unitary construction with said divider wall and the other leg being slightly below a bottom edge of said divider wall so as to define said slot.

5. The apparatus of claim 4, wherein the wastebasket is substantially rectangular in shape, said divider wall extending across the narrower dimension of the wastebasket.

6. The apparatus of claim 5, wherein said base member is rectangular in shape and is positioned against the bottom wall of the wastebasket.

7. An apparatus for dividing a wastebasket having side walls and a bottom wall into multiple compartments, comprising:

(a) a base member, at least a portion of said base member being positioned against the bottom wall of the wastebasket;

(b) a flexible divider wall having an upper end and an opposite bottom end interconnected to said base member, first and second compartments being defined by said divider wall and the wastebasket said walls, wherein said divider wall can be flexed in a first direction to close off said first compartment, and said divider wall can be flexed in a second direction to close off said second compartment, and wherein said divider wall has a slot proximate its bottom end through which said base member is inserted to allow for movement of said divider wall relative to said base member; and (c) support means for maintaining said divider wall in a substantially upright position.

8. The apparatus of claim 7, wherein said apparatus is made of a plastic material.

9. The apparatus of claim 8, wherein the wastebasket is substantially rectangular in shape, said divider wall extending across the narrower dimension of the wastebasket.

10. The apparatus of claim 9, wherein said support means comprises a bracket member of unitary construction with said divider wall.

* * * * *